United States Patent [19]

Aoki

[11] Patent Number: 4,657,465

[45] Date of Patent: Apr. 14, 1987

[54] APPARATUS FOR STACKING SMALL BUNDLES OF SIGNATURES

[75] Inventor: Minoru Aoki, Yokohama, Japan

[73] Assignee: Nichiro Kogyo Company, Ltd., Yokohama, Japan

[21] Appl. No.: 703,491

[22] Filed: Feb. 20, 1985

[30] Foreign Application Priority Data

Jul. 13, 1984 [JP] Japan ..... 59-145749

[51] Int. Cl.[4] ..... B65G 57/06

[52] U.S. Cl. ..... 414/31; 414/54; 414/907

[58] Field of Search ..... 414/31, 66, 82, 50, 414/62, 56, 54, 65, 907; 271/220

[56] References Cited

U.S. PATENT DOCUMENTS

| | | | |
|---|---|---|---|
| Re. 25,018 | 8/1961 | Howdle et al. | 414/50 X |
| 3,255,895 | 6/1966 | Klingler | 414/50 X |
| 3,566,757 | 3/1971 | Fujishiro | 414/31 X |
| 3,568,578 | 3/1971 | Fijishiro | 414/50 X |
| 4,264,255 | 4/1981 | Saro et al. | 414/31 |
| 4,432,685 | 2/1984 | Stauber | 414/31 |
| 4,457,656 | 7/1984 | Kosina et al. | 414/65 X |
| 4,547,112 | 10/1985 | Steinhart | 414/31 |

FOREIGN PATENT DOCUMENTS

| | | | |
|---|---|---|---|
| 0153983 | 9/1985 | European Pat. Off. . | |
| 2827540 | 11/1979 | Fed. Rep. of Germany . | |
| 3043035 | 6/1982 | Fed. Rep. of Germany . | |
| 57-189965 | 11/1982 | Japan . | |
| 2080255 | 2/1982 | United Kingdom | 414/907 |
| 2082548 | 3/1982 | United Kingdom . | |
| 289048 | 2/1971 | U.S.S.R. | 271/220 |

OTHER PUBLICATIONS

Patents Abstracts of Japan, vol. 9, No. 135(M-386) (1858), Jun. 11, 1985; & JP-A-60 15352 (Nihon Boorudouin K.K.) 26-01-1985.

*Primary Examiner*—Robert J. Spar
*Assistant Examiner*—Janice Krizek
*Attorney, Agent, or Firm*—Oblon, Fisher, Spivak, McClelland & Maier

[57] ABSTRACT

An apparatus for stacking signatures is compactly constructed with a device to receive and forward horizontally a stream of the signatures partially overlapped from the end of a conveyor connected to the end of a rotary printing press; a device to pile up vertically the signatures into a small bundle; a frame member to stack up the small bundle directly underneath the piling device, such frame member being rotatable 180° to turn each small bundle alternately for stack compensation; and a receiving table movable vertically within the frame member by an elevating mechanism and rotatable along with the frame member.

6 Claims, 13 Drawing Figures

APPARATUS FOR STACKING SMALL BUNDLES OF SIGNATURES

BACKGROUND OF THE INVENTION

The present invention relates to an automatic apparatus for stacking signatures which are discharged from a rotary printing press. More particularly, it is concerned with an automatic apparatus for stacking small bundles of signatures, wherein the signatures are piled up evenly in a small bundle, then this small bundle is rotated 180 degrees and stacked one by one alternately for stack compensation to form a large bundle of such signatures.

As this type of the device, there has so far been known such an apparatus as disclosed in Japanese Unexamined Patent Publication No. 189965/1982. The conventional apparatuses including the one disclosed in the referenced publication, however, are composed separately of a section for piling up signatures into a small bundle, a rotary section to change the direction of the bundles alternately, and a section for stacking these small bundles. Moreover, each section is provided at a different location with the result that the entire structure of the apparatus becomes inevitably large in size. In the following, explanations will be given as to the embodiment disclosed in the referenced Japanese Unexamined Patent Publication No. 189965/1982.

As shown in FIG. 8 of the accompanying drawing, the conventional automatic bundle stacking apparatus is composed of a piler B, a rotary section C, and a stacker section D, each being at a separate position. A reference letter A designates a paced signature conveyor, and a reference letter a denotes a sorting device. The signatures E which have been conveyed in condition that they are partially overlapped in a stream are further carried forward while they are being clamped between conveyor belts F and G. As soon as the signatures hit a stopper H, they drop one by one in a horizontal posture onto a receiving table U and pile up thereon gradually. In the meantime, the receiving table U lowers its position in order to maintain the uppermost surface of the piled signatures E at a substantially constant level. As soon as a predetermined amount of the signatures for a bundle has been reached, the sorting device a is actuated and the receiving table U is rapidly lowered to place a pile P of the signatures on a conveyor Y. Then, it returns to the original position. While the receiving table U performs such rapid vertical motion, the stream of signatures E is temporarily stopped by a fork I which is able to travel both horizontally and vertically. A cylinder X, a pinion L, and a pinion rack K constitute a mechanism for moving the table U horizontally and vertically. When the small bundle P of the signatures E on the conveyor Y hits a stopper J and terminates its forward movement, a table O is raised by means of a cylinder W, and, after performance of a required rotational movement by means of a pinion M and a pinion rack N, it is lowered. The small pile P of the signatures E is again sent forward by a conveyor Y'. As soon as it hits a stopper Z and terminates its movement, a table Q is elevated by means of a pinion R and a pinion rack S. When the uppermost surface of the small bundle P of the signatures E comes into contact with the lower surface of a large bundle supporting fork V, the fork V is opened as indicated by double-dot-and-dash lines V', and the table Q is further elevated upward until its top surface reaches a position slightly above the top surface of the supporting fork V and is stopped there. Then, the supporting fork V is closed and the table Q begins to descend. Then, if one or more small bundles P have already been stacked on the supporting fork V, the bundle now coming in by the ascending table Q will be placed above the bundles previously stacked. In this manner, the stacking is repeated. When the predetermined numbers of the small bundles P have been stacked with the lowest bundle being positioned by the ascending table Q to be slightly above the top surface of the supporting fork V, a carrier T with its forks being open begins to close its fork. Then, the table Q is again descended. The stacked bundles P are now held by the forks of the carrier T and are transferred to the next station in the work.

As has been explained, in the conventional apparatus, the section for piling up signatures into a small bundle, the section for turning it 180° alternately, and the section for stacking the small bundles to form a large bundle are separately positioned. Therefore, the entire structure of the apparatus inevitably becomes large so as to require a larger floor space for its installation.

SUMMARY OF THE INVENTION

The object of the present invention is to provide an apparatus for stacking small bundles of signature, of a small size and a light weight.

The foregoing and the other objects of the present invention have been attained by providing an apparatus for stacking small bundles of signatures, including a device to receive a stream of signatures and pile up vertically the signatures into a small bundle at the end of a conveyor which carries the stream of signatures from a printing press machine; a frame member placed underneath the device to stack up the small bundle, the frame member being rotatable 180° to turn each small bundle alternately for stack compensation, and a table means capable of vertical movement and rotatable horizontally with the frame member.

The foregoing object, other objects as well as the specific construction and functions of the automatic apparatus for stacking small bundles according to the present invention will become more apparent and understandable from the following detailed description of a preferred embodiment thereof, when read in conjunction with the accompanying drawing.

In the following, the present invention will be explained in detail in reference to the accompanying drawings illustrating the preferred embodiment thereof.

Figure 9A:
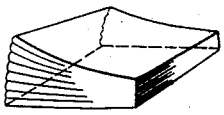
FIGS. 9A and 9B are respectively perspective views showing states of folded sheets as piled up.
Figure 9B:
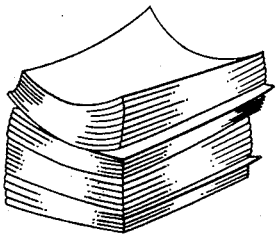
Figure 12:
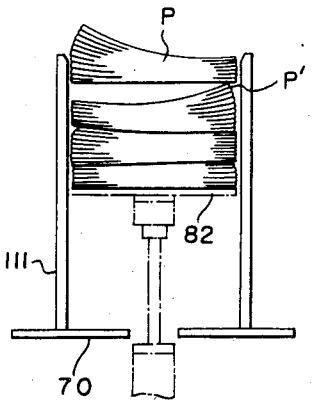
FIG. 12 is a schematic explanatory diagram showing a state of the small bundles of sheets being piled up, when no pressing claws are provided on the stacking device.

Usually, the uppermost surface of the small bundle of the signatures is not even and horizontal. As seen from FIG. 9A, a folded portion of the signature bulges out as the number of the signature increases, and further, bulge-out would be observed at the folded portion when the signatures are folded into four. As the consequence of this, when the initial small bundle is lowered, on which the subsequent small bundles are stacked one by one, the top end P' of the small bundle is caused to shear when it is hit by the bottom surface of the small bundle P dropping from above and the opposite end thereof protrudes outwards, as shown in FIG. 12, even if the direction of the folded end portion of each small bundle is alternately turned at an angle of 180 degrees. As the number of times of stacking the small bundles increases, there occurs shear at the boundary between the adjacent small bundles, or a crease between them. In the system of stacking the small bundles from the bottom to the top at separate positions, the small bundle is pushed upwards to press the folded portion of the small bundle to be lifted up from below by the weight of the large bundles which have already been stacked on it previously, thereby preventing the shear and the crease from taking place in the bundles.

Figure 10:
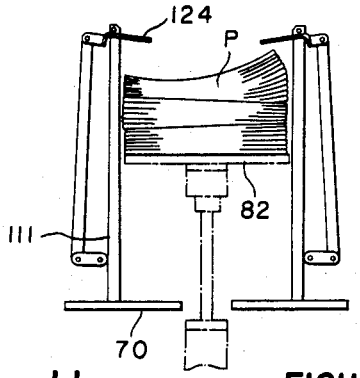
FIGS. 10 and 11 are schematic explanatory diagrams showing the states of small bundles of sheets being piled up, when pressing claws are provided on the small bundle stacking device.
Figure 11:
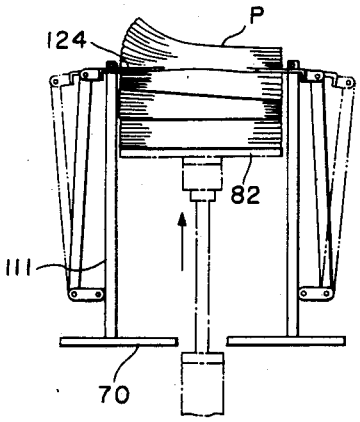

With a view to preventing various disadvantages from taking place in the system wherein the small bundles are dropped from the top part, the stacking apparatus according to the present invention is so constructed that it provides claws, which are the most remarkable feature of the present invention, to appear and disappear from both outer sides on the mutually opposed top surface part of the frame body. With these claws, the folded portion of the signatures P which have already been piled up are compressed, as shown in FIGS. 10 and 11, at every time the vertically movable table goes upward to render the uppermost surface of the bundle to be even and horizontal, thereafter the small bundles are sequentially stacked from above, and then the claws are pulled out by retracting them outward of both sides, followed by lowering of the vertically movable table. With such construction of the stacking apparatus according to the present invention, it becomes possible to avoid undesirable shear and crease at the boundary surfaces between the small bundles, to pile up the bundles into a large stack having a regular rectangular shape in the cross-section, and to reduce the overall size of the apparatus to the minimum possible extent.

An embodiment of the present invention will be described with reference to FIG. 1. A reference numeral 1 designates a conveyor for signatures extending from a rotary printing press machine (not shown in the drawing); numerals 2, 2' refer to lower conveyors to transport the signatures in synchronism with the conveyor 1; and a numeral 3 refers to an upper conveyor which also functions to convey the signatures in cooperation with the lower conveyors 2, 2'. Namely, the signatures which have been transported by the lower conveyors 2, 2' clamped by the upper conveyor 3 in association with the lower conveyor 2' are sent forwardly to the top surface 11' of an upper signature receiving member 11.

The lower conveyors 2, 2' and the upper conveyor 3 are both constructed in such a manner that a plurality of belts are extended between rollers with an appropriate space interval among them, and that the upper signature receiving member 11 passes through these space intervals. Numerals 4 and 5 refer respectively to a stopper plate and a stopper piece, both of which are disposed at the end position of the belt conveyor 2 in an opposed relationship so as to stop the signatures temporarily. The stopper plate 4 and the stopper piece 5 are moved by air cylinders 6 and 7 associated with them respectively to positions 4' and 5' shown by dot-and-dash lines where both come closer each other, and each of the signatures is caught at the upper side of the lower conveyor 2 to be stopped temporarily. Reference numerals 8 and 9 designate respectively a light emitter and a light receiver of a photo-electric tube, by which a signal is generated to actuate the air cylinders 6, 7 when the signatures reach a predetermined number based on a signal generated upon interception by the forward end of a signature. From that time onward, the required number of signatures is grouped with an interval between one signal and the other. A reference numeral 10 denotes a space where the predetermined number of the signatures are stacked. When the signatures are sent in, the upper signature receiving member 11 is lowered in this space at a controlled speed so as to maintain the uppermost surface of the stacked signatures in a horizontal state. A numeral 12 refers to a lower signature receiving member. A numeral 13 refers to a guide member for the rear ends of the signatures, which is fixed at a position substantially matching with the exit end of a belt surface 2" of the lower conveyor 2'. A reference numeral 14 denotes a guide member for the forward ends of the signatures, the top end 14' of which is oscillated by a motor 15 to neatly arrange the front and rear edges of the signatures to be stacked.

Figure 1:
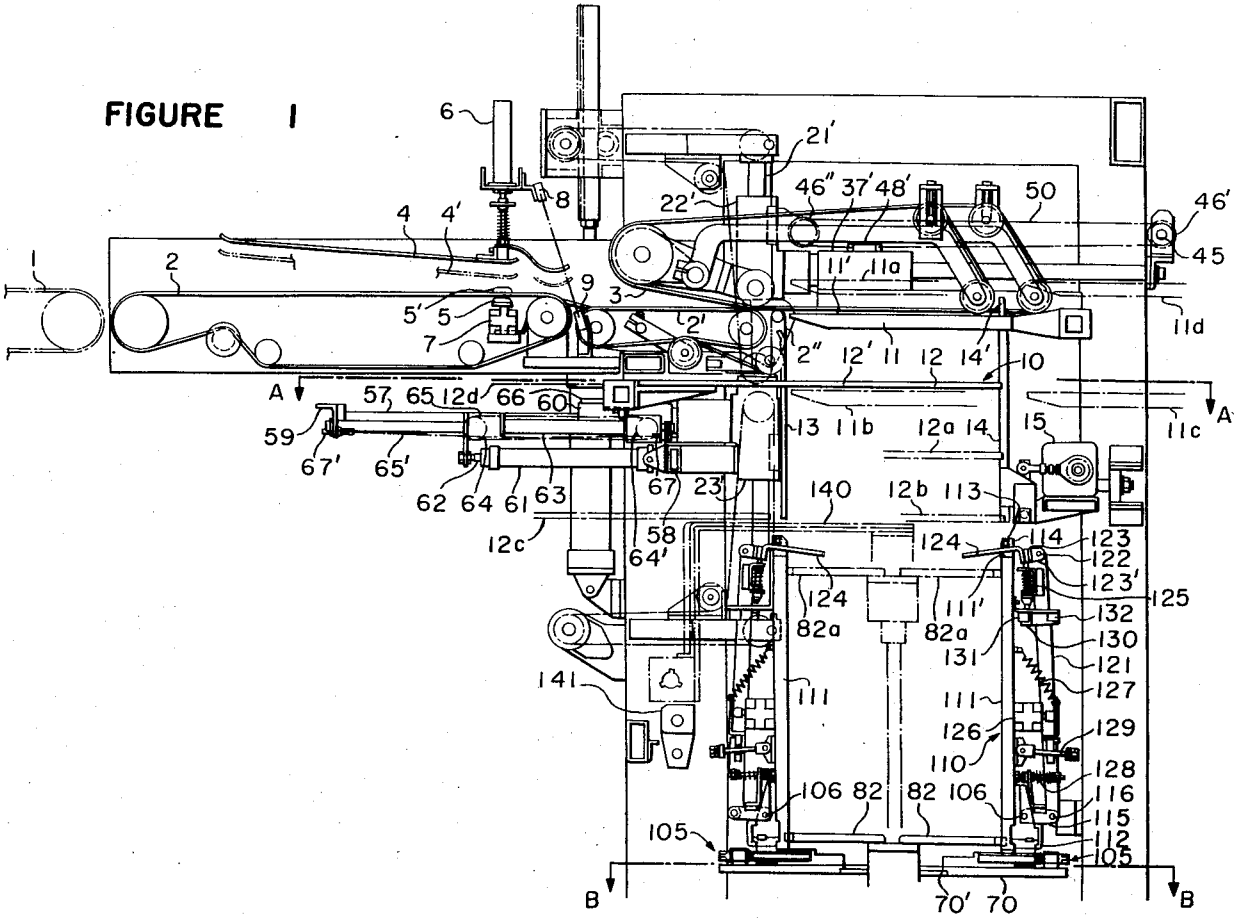
FIG. 1 is a side elevational view, in longitudinal cross-section, showing a preferred embodiment of the small bundle stacking apparatus according to the present invention.
Figure 2:
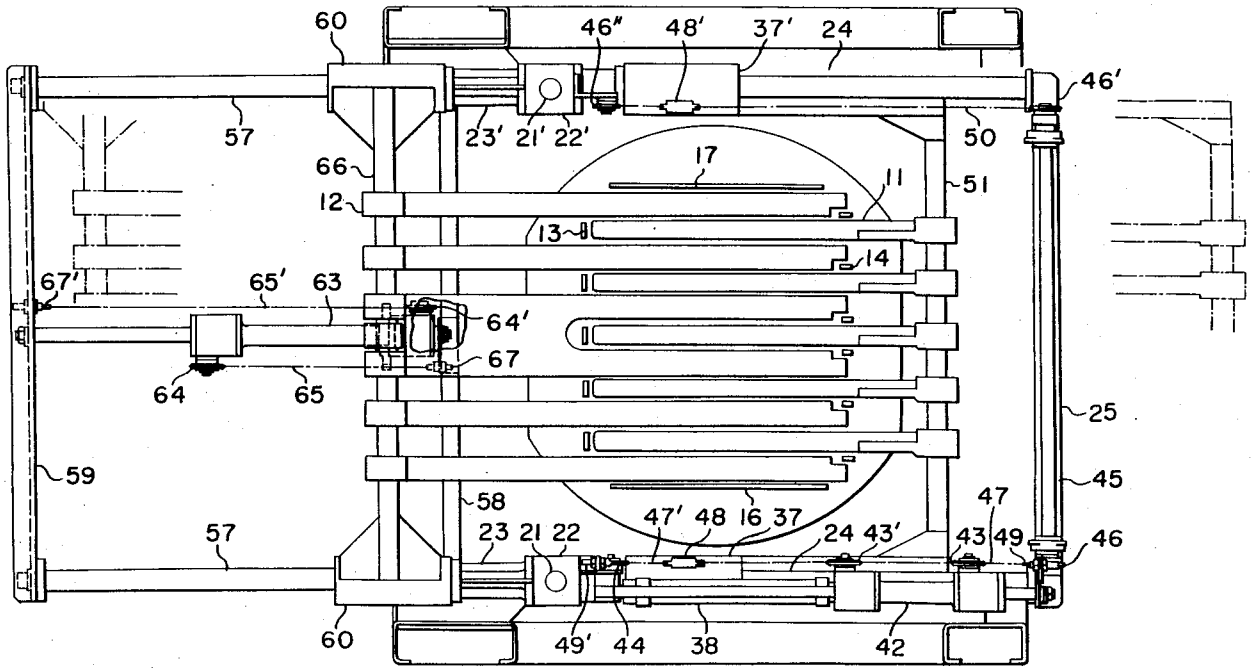
FIG. 2 is a plan view of the apparatus, taken along a line A—A in FIG. 1.

FIG. 2 illustrates a plan view, taken along a line A—A in FIG. 1, of the upper and lower signature receiving members 11 and 12, on the assumption that the upper signature receiving member 11 has been lowered to a position 11*b* shown with a chain line. As seen from FIG. 2, the upper and lower signature receiving members 11 and 12 are both in a fork shape, each being interleaved into a space interval of the counterpart. Numerals 16 and 17 are guide plates for restraining the left and right sides of the signatures to be stacked. Although any detailed showing has been dispensed with, the guide plates are so constructed that either of them is fixed and the remainder is made oscillatable at its top end by a motor, as is the case with the guide plate 14 shown in FIG. 1, so as to neatly arrange the left and right edges of the signatures to be stacked.

In the course of the upper signature receiving member 11 being lowered to the position 11*b*, when the top surface 11' of the upper signature receiving member 11 becomes lower than the top surface 12' of the lower signature receiving member 12, the signatures which have been stacked by that time can be transferred to the lower signature receiving member 12 without any obstacle whatsoever. When the upper signature receiving member 11 is lowered to the position 11*b*, it is subsequently retracted to its position 11*c*, followed by movement to its raised position 11*d*, and then, it is moved forward to its position 11*a*. Details of the movement of the upper signature receiving member 11 to its respective positions 11*b* to 11*a*, after transfer of the signature to the lower signature receiving member 12 will be explained later.

On the other hand, the lower signature receiving member 12 which has received the signatures from the upper signature receiving member 11 is lowered, while maintaining the uppermost surface of the signatures in an even state. About the time when it reaches the position 12*a*, a signal is supplied from the rotary printing press machine to the air cylinders 6 and 7 for the stopper plate and the stopper piece, respectively, whereby forwarding of the signatures is temporarily stopped. This temporary stoppage time is very brief and then, the operation of the lower signature receiving member 12 is changed to be rapidly lowered to the position 12*b*, and, with a slight delay, the upper signature receiving member 11 is also lowered at a rapid speed from its stand-by position 11*a* to its initial position shown by a solid line as projected into the space 10. Simultaneously, the air cylinders 6 and 7 release the temporary stoppage of the signatures to send them. The lower signature receiving member at the position 12*b* is then withdrawn to the position 12*c* at a rapid speed, and the small bundle of the signatures as piled up is dropped a short distance, without disturbing its posture, with its rear end being restricted by the guide member 13 to be transferred to and placed on the top surface of the claws 124, 124 in the stacker. Explanations about the large bundle accumulation will be made at a later paragraph.

In the following, explanations will be given in reference to FIG. 3 as to the outline of the structure for effecting the vertical and horizontal movements of the upper signature receiving member 11 and the lower signature receiving member 12. Reference numerals 21, 21' designate vertical shafts fixedly secured to a frame 20. On these vertical shafts 21, 21', there are loosely fitted two pairs of slide blocks 22, 22' and 23, 23' in a manner to be movable in the vertical direction. One end of each of horizontal shafts 24, 24 is fixed to each of the upper pair of the slide blocks 22, 22', and the other ends thereof are joined with an angled member 25. A pinion rack 28 is fixed to a piston rod 27 of an air cylinder 26, the lower end of which is supported on the frame 20 and which is capable of being stopped half-way. Although a pinion to be meshed with this pinion rack 28 is not shown in the drawing, it is placed in a shaft casing 29 fixed onto the frame 20, and is keyed to one end of a connecting shaft 30. The other end of the connecting shaft 30 is rotatably held by a bracket 32 fixed on the frame 20. The ends of roller chains 35, 35 which are wound on sprocket wheels 31, 31 fixedly secured to the connecting shaft 30, intermediate sprocket wheels 33, 33' fixed to the upper and intermediate parts of the vertical shafts 21, 21', and tension-adjusting sprocket wheels 34, 34 are connected with fixed pieces 36, 36 (also refer to FIG. 4) secured to the slide blocks 22, 22'. When the air cylinder 26 is actuated in the direction to stretch the piston rod 27, the slide blocks 22, 22', the horizontal shafts 24, 24 fixed to these slide blocks, the angled member 25, and so on move upward together. On the contrary, when the piston rod 27 is retracted, the slide blocks 22, 22', and so forth are lowered. Reference numerals 37, 37' in FIG. 2 designate slide blocks which are loosely fitted on the horizontal shafts 24, 24 and are moved horizontally. This horizontal movement is effected in the following manner. That is to say, as shown in FIGS. 2 and 4, one end of the air cylinder 38 is connected to the vertically movable slide block 22 through a pin 40; then roller chains 47, 47' are respectively wound, as illustrated, on sprocket wheels 43, 43' rotatably provided on both ends of a sliding member 42 secured to its piston rod 39, a sprocket wheel 44 loosely fitted on the pin 40, and a sprocket wheel 46 keyed to a connecting shaft 45 provided on the top surface of the angled member 25, one end of each of the roller chains 47, 47' being connected with a connecting piece 48 secured on a slide block 37, and the other end thereof being connected with each of adjusting screws 49, 49' to be subjected to appropriate tension; further, a sprocket wheel 46' is keyed to the other end of the connecting shaft 45 as shown in FIGS. 1 and 2, and both ends of a roller chain 50 wound on this sprocket wheel 46' and a sprocket wheel 46'' rotatably provided on the slide block 22' are connected with a connecting piece 48' secured to a slide block 37'.

Figure 3:
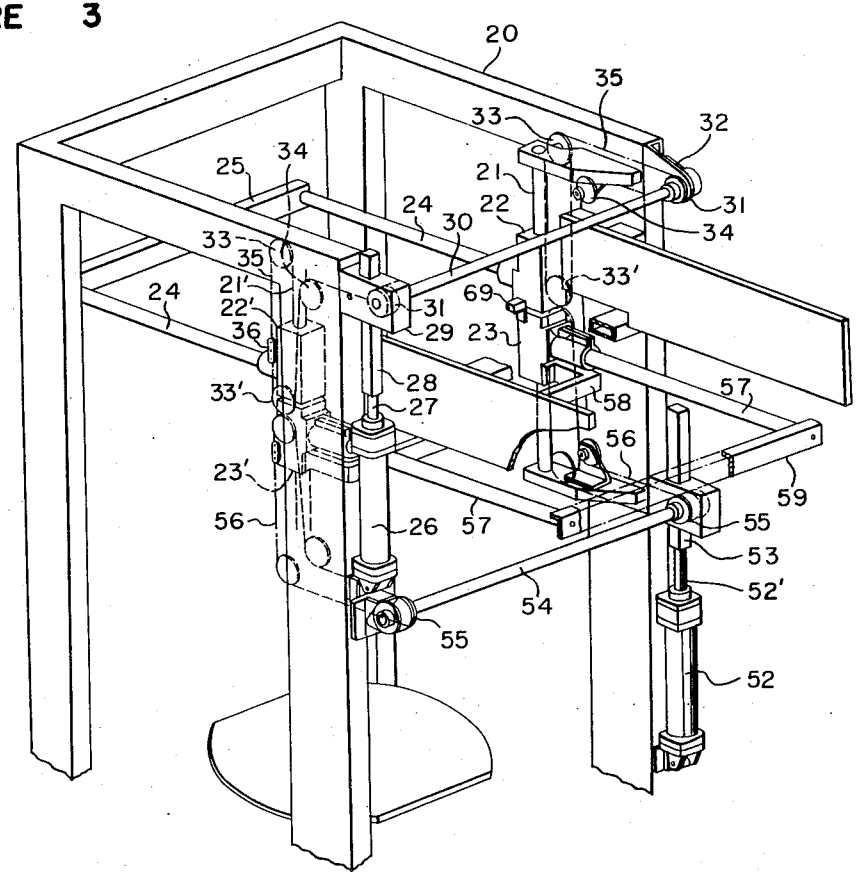
FIG. 3 is a perspective view of a main part for explaining the vertical and horizontal movements of both upper and lower signature receiving members.
Figure 4:
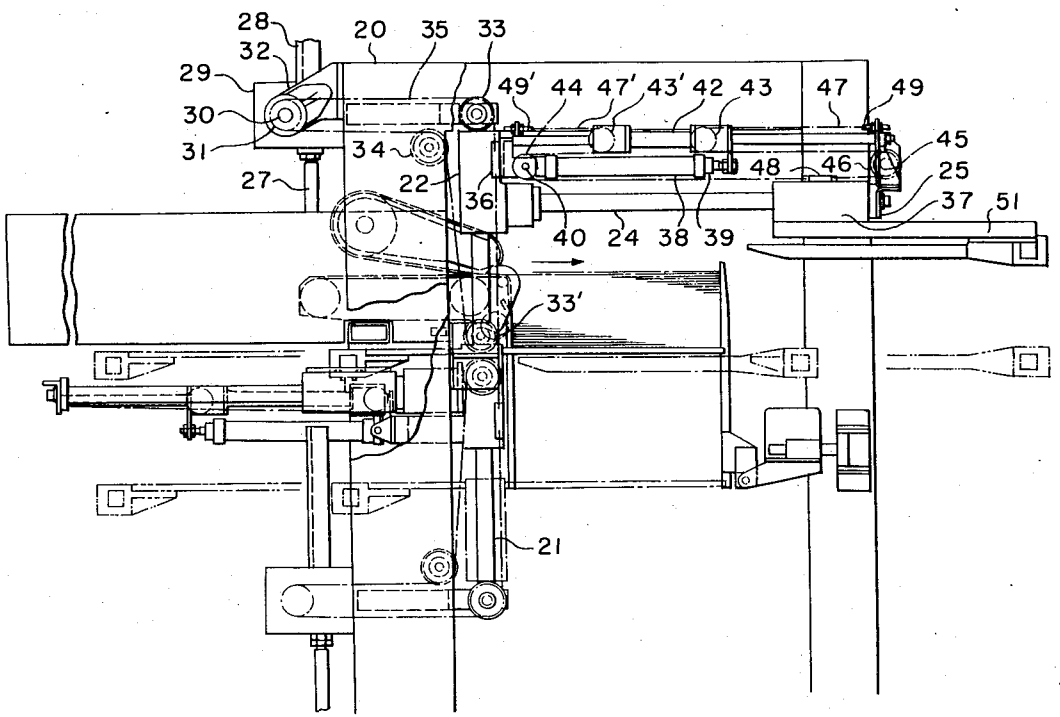
FIG. 4 is a side elevational view for explaining the horizontal movement of the upper signature receiving member.

As shown in FIGS. 2 and 4, the upper signature receiving member 11 is fixed on a frame member 51 in an angled U-shape which in turn is fixed on the lower surface of the slide blocks 37, 37', hence it is integral with the slide blocks 37, 37'. In FIG. 4, when an air cylinder 38 is actuated in the direction to extend the piston rod 39, the sliding member 42 is shifted rightward, whereby the roller chain 47' wound on the sprocket wheel 43' pulls the slide block 37 leftward. When the slide block 37 is moved in the left direction, the roller chain 47 causes the sprocket wheel 46 and the connecting shaft 45 to rotate in the clockwise direction. Upon the clockwise rotation of the sprocket wheel 46' in FIG. 1 by the connecting shaft 45, the roller chain 50 causes the slide block 37' to move leftward. In other words, the slide blocks 37, 37' are moved leftward in parallel with each other, and the upper signature receiving member 11 is shifted toward the space 10. When the air cylinder 38 is actuated in the direction to retract the piston rod 39, the sliding member 42 is moved in the leftward direction and the roller chain 47 wound on the sprocket wheel 43 pull the slide block 37 to the right, while simultaneously rotating the sprocket wheel 46 and the connecting shaft 45 in the counter-clockwise direction. As the result of this, the slide blocks 37, 37', contrary to what has been mentioned in the foregoing, are moved in parallel with each other to the right, whereby the upper signature receiving member 11 is withdrawn from the space 10. By thus constructing the vertical and horizontal moving mechanism for the upper and lower signature receiving members, a moving stroke of the piston rod 39 can be halved with respect to the horizontal moving distance of the upper signature receiving member 11, which contributes to the size-reduction in the stacker as a whole. Substantially the same as mentioned above is applicable to the vertical and horizontal movements of the lower signature receiving member 12. That is to say, the air cylinder 52 shown in FIG. 3 is capable of stopping half way, the connecting shaft 54 is driven by the pinion rack 53 fixed to the piston rod 52', and the slide blocks 23, 23' are moved vertically in parallel by the roller chains 56, 56 wound on the sprocket wheels 55, 55 keyed at positions near both ends of the connecting shaft 54. Also, each end of the horizontal shafts 57, 57 is fixed to the slide blocks 23, 23'. Besides this, a horizontal beam 58 is also fixed thereto. Between this horizontal beam 58 and the angled member 59 fixed to the other ends of the horizontal shafts 57, 57, there are provided an air cylinder 61 and a sliding member 63 fixedly secured to its piston rod 62, as shown in FIGS. 1 and 2. One end of roller chains 65, 65' wound on sprocket wheels 64, 64' rotatably provided on both sides of the sliding member 63 is connected with a frame member 66 fixed to slide blocks 60, 60 which are loosely fitted on the horizontal shafts 57, 57, while the other end of the roller chains 65, 65' is connected with adjusting screws 67, 67' respectively provided on the horizontal beam 58 and the angled member 59. When the air cylinder 61 is actuated in the direction to extend the piston rod 62, the lower signature receiving member 12 fixed on the frame 66 is moved leftward to be retracted from the space 10. When it moves in the direction opposite to the above, the lower signature receiving member 12 is moved toward the space 10.

A reference numeral 69 in FIG. 3 designates a proximity switch fixed on the slide block 23. The switch is installed in such a way that it may face the inside surface of the slide block 22 with a small clearance therebetween. It serves to detect a timing when the upper signature receiving member 11 is lowered, while maintaining the uppermost surface of the signatures at a substantially even state, and hands the signatures over to the lower signature receiving member 12, i.e., a timing when the top surface 11' of the upper signature receiving member 11 becomes matched with the top surface 12' of the lower signature receiving member 12. By a signal as detected, the upper signature receiving member 11 is subjected to rapid vertical and horizontal movements from its position 11*b* to its other positions 11*c*, 11*d* and 11*a*, and, at the same time, the lower signature receiving member 12 is caused to move downward, while maintaining the uppermost surface of the signatures at a substantially even state.

Figure 5:
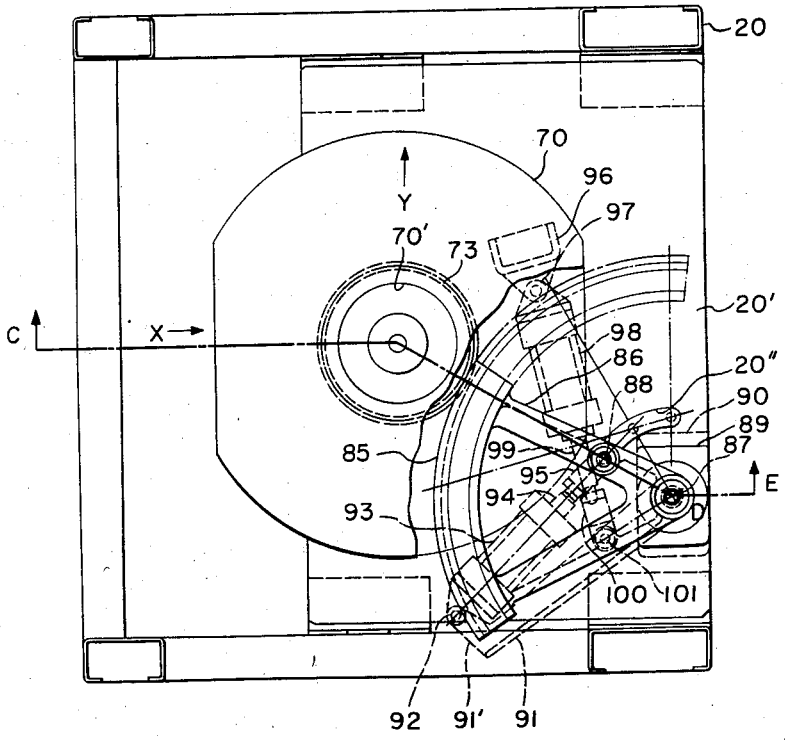
FIG. 5 is a plan view of the small bundle stacking section, taken along a line B—B in FIG. 1.
Figure 6:
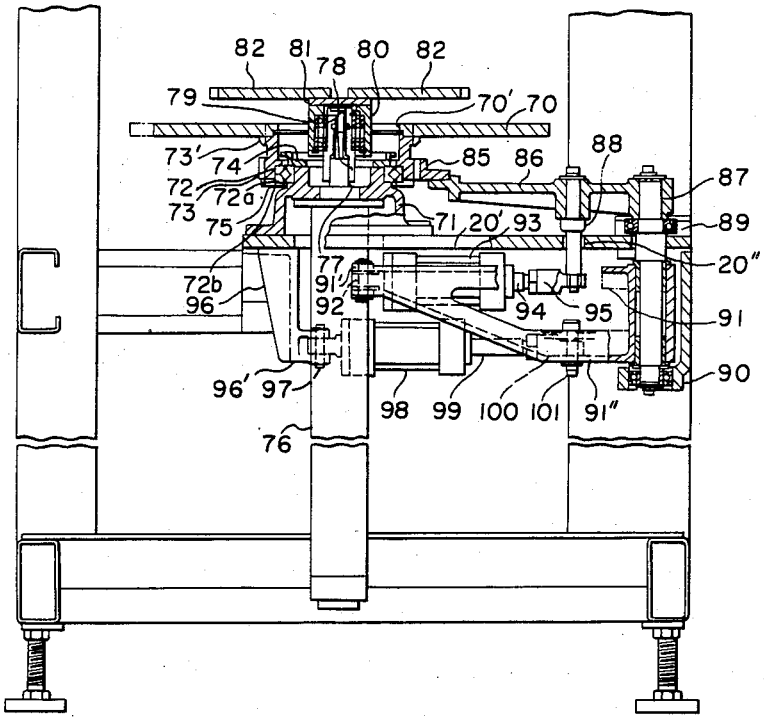
FIG. 6 is a cross-sectional view of the small bundle stacking section shown in FIG. 5, taken along a line C—O—D—E therein.

In the following, explanations will be given as to the small bundle stacking device. Referring to FIGS. 1, 5 and 6, a reference numeral 70 designates a turn table, the center part of which is made hollow 70'. Beneath the turn table 70, there is provided a horizontal base member 71 which is secured to a horizontal plate 20' fixed to the frame 20. An inner ring 72*a* of a cross-roller bearing 72 is fixed to the horizontal base member 71, while the turn table 70 is fixed on a flange portion 73' of a spur gear 73 which is fitted on an outer ring 72*b* of the bearing.

A reference numeral 74 designates a flange member for fixing the inner ring 72*a* of the bearing 72 to the horizontal base member 71, and a numeral 75 refers to another flange member for fixing the outer ring 72*b* of the same bearing to the spur gear 73. An air cylinder 76 is fixedly provided on the lower surface of the horizontal base member 71. Two pieces of ball bearing 79 are fitted in the inner cylindrical body 78 fixed to a piston rod 77. A rectangular plate 81 is fixedly secured to an outer cylindrical body 80 fitted on the outer ring of the ball bearing. Vertically movable tables 82, 82 are fixed on this rectangular plate 81. As shown in the drawing, the outer cylindrical body 80 is vertically movable by passing through the hollow 70' formed at the center part of the turn table 70. Also, this small bundle stacking device is so constructed that no rotation is transmitted to the piston rod 77, even if the vertically movable tables 82, 82 are rotated along with the turn table 70.

Of FIGS. 5 and 6, FIG. 6 illustrates its one part in accordance with a developed view, for the sake of convenience, wherein a sector gear 85 to be meshed with the spur gear 73 is fixed on a sector arm 86 which, in turn, is secured to a pivotal shaft 87 to be a pivot for the sector arm. The pivotal shaft 87 is further supported in a freely rotatable manner on an upper bearing 89 and a lower bearing 90, both being fixedly supported on the horizontal plate 20'. Distal end 91' of a swing arm 91 loosely fitted between both bearings 89, 90 beneath the pivotal shaft 87 is in a bifurcated shape. A pin 92 is provided on this swing arm 91, and an air cylinder 93 is connectively provided with its one end being supported on this pin 92. A connecting head 95 fixedly secured to the piston rod 94 is connected with a driving pin 88 which is fixed at the main part of the sector arm 86 and hangs down through a slot 20" formed in one part of the horizontal plate 20'. Further, an air cylinder 98 is provided with its one end being supported on a pin 97 provided at a bifurcated portion 96' at the lower end of a bracket 96 which is fixed at the main part of the horizontal plate 20'. A connecting head 100 fixedly secured to a piston rod 99 is connected with the bifurcated portion 91' provided at the lower main part of the swing arm 91 by means of a shoulder pin 101. Assume now that the signatures to be sent into the small bundle stacking device are forwarded from a location C in the direction of an arrow mark X, which is piled up on the turn table 70 having its center O and is pushed out in the direction of an arrow mark Y. In this case, the subsequent small bundles of the signatures may be piled on the turn table 70 with its direction being kept as it is; however, a small bundle after the next must be piled with the turn table 70 being rotated by 180°. In this embodiment, a gear ratio between the spur gear 73 and the sector gear 85 is taken 1:3. As the consequence of this, the sector gear 85 is to be rotated by 60° in the clockwise direction, in this instance. The piston rod 94 of the air cylinder 93 in this case is in a retracted state, while the piston rod 99 of the air cylinder 98 is extended. Therefore, when the air cylinder 93 is actuated in the direction of extending its piston rod 94, with the air cylinder 98 being actuated to extend the piston rod, the drive pin 88 is shifted in the clockwise direction, whereby the sector arm 86 fixing the drive pin 88 thereon and the sector gear 85 are rotated by 30° in the clockwise direction, and the spur gear 73 and the turn table 70 fixed thereto are rotated by 90° ($30\times3=90$) in the counter-clockwise direction. Subsequent to this, when the air cylinder 93 is kept in active condition and the air cylinder 98 is actuated in the direction of extending its piston rod 99, the swing arm 91 pushes the drive pin 88 in the clockwise direction, while maintaining the air cylinder 93 in a state of the piston rod having been extended, whereby the sector gear 85 is further rotated by 30° in the clockwise direction, and the turn table 70 is further rotated by 90° in the counter-clockwise direction, thereby attaining the rotation of 180° in total. When reversely rotating the turn table for stacking the next small bundle, the air cylinder 93 is actuated in the direction of retracting its piston rod, and then the air cylinder 98 is actuated in the direction of extending its piston rod, whereupon the turn table 70 is rotated by 180° in total in the clockwise direction to reinstate its original state.

Figure 7:
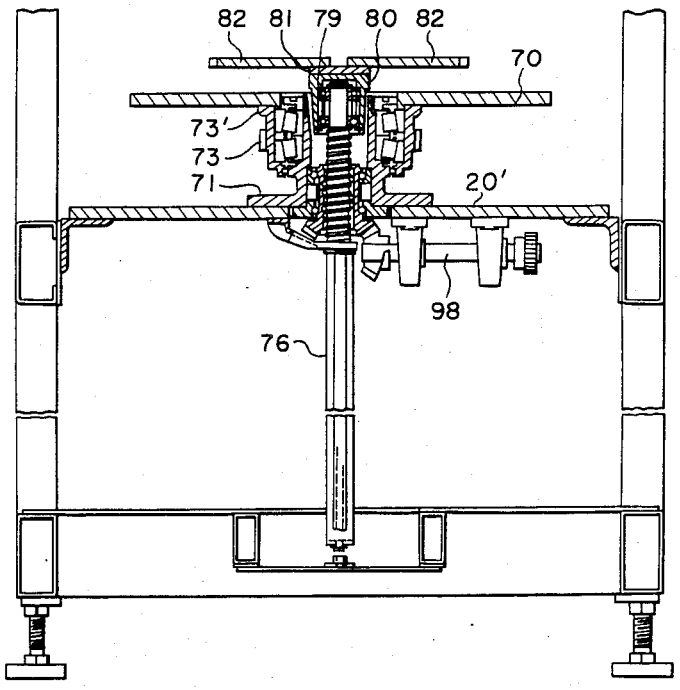
FIG. 7 is an explanatory diagram of another embodiment of the small bundles stacking section according to the present invention.
Figure 8:
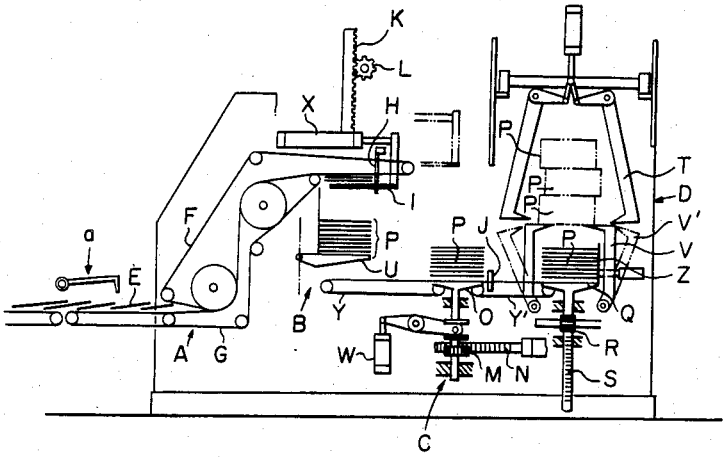
FIG. 8 is a schematic diagram showing a layout of one embodiment of a conventional bundle stacking apparatus for folded printed sheets.

FIG. 7 illustrates another embodiment of the small bundle stacking device according to the present invention, wherein use is made of two pieces of tapered roller bearing, in place of the cross-roller bearing, for rotatably supporting the turn table 70, and ball screws are used for moving the tables 82, 82 in the vertical direction. For changing the direction of the turn table, it is possible to move the pinion rack with two cylinders, instead of using the sector gear 85. On the top surface of the turn table 70 which rotates in the above-mentioned manner, plural pairs of adjusting blocks 105 which are conformable to the length of the signatures to be stacked are provided, to which plural pairs of upright pillars 111 forming the signature guide surface of the frame member 110 are fixed by means of fixing pieces 112. One end of a link 115 is supported on pivot pins 106, 106 provided on the adjusting blocks 105. Two oscillating levers 121 are provided on both left and right sides with a pin 116 at the other end of the link 115 as the pivotal point, and a lug 123' of a connecting beam 123 is pivotally supported on a pivot pin 122 on the upper end of the oscillating rod 121. A plurality of pairs of claws 124 are fixedly provided on this connecting beam 123. The top end 111' of the upright pillar 111 is in a bifurcated shape, and is also provided with a pin 113. Small rollers 114 are rotatably provided on the upright pillars 111. The claw 124 has a width which is approximately 2.5 times as large as that of the upright pillar 111, and has a notched portion formed therein to permit the bifurcated portion of the upright pillar 111 to come into it. As the consequence of this, the claw is in the form of three parallel strips, the distal end of which is lifted up by a spring 125, while the top surfaces at both sides of the notched portion are in contact with the small rollers 114. A numeral 126 refers to an air cylinder provided substantially at the intermediate portion of the upright pillar 111 to outwardly push open the top end of the oscillating lever 121. Springs 127 and 128 serve to reinstate the pushed-open oscillating lever 121 to its old position, and to impart a reactionary force to the pivot pin 122 on the top end of the oscillating lever 121 when the vertically movable tables 82, 82 are moved upwardly with the signatures mounted thereon, while the oscillating lever 121 is in the illustrated state, to apply compressing force to the folded portion of the signatures between them and the claws 124. A reference numeral 129 designates a stopper to prevent the oscillating lever 121 from opening excessively by inertia, when it is pushed open by means of the air cylinder 126.

Reference numerals 131 and 132 denote proximity switches attached to one of the upright pillars 111 at a position somewhat upward thereof. A numeral 130 refers to a sensing plate attached to the oscillating lever 121. FIG. 1 shows a state that the proximity switch 131 is turned on, the top end of the oscillating lever 121 comes closer to the upright pillar 111, and the claw 124 is at a position to receive the small bundle of signatures. When the proximity switch 132 is turned on, the oscillating lever 121 is pushed open by the air cylinder 126 and the claw 124 is retracted outwardly of the signature guide surface of the upright pillar 111.

In the following, the operations of the small bundle stacking device of the above-described construction will be explained. The stacking operation of the small bundles commences from the time instant when the lower signature receiving member 12 is lowered to its position **12*b*, and then rapidly retracted to its further position 12*c*, whereby a small bundle of signatures is transferred to and placed on the top surface of the claws 124. At this time instant, the vertically movable tables 82, 82 are already shifted to their highest positions 82*a*, 82*a* to get ready for the next action. The plural pairs of claws 124, 124, on which a small bundle of signatures have been mounted, are retracted by the oscillating levers 121 which are pushed open by the action of the air cylinder 126, whereby the small bundle is shifted to the vertically movable tables 82, 82. Since both edges of the lower part of the small bundle which has thus far been placed on the claws 124, 124 are somewhat pushed in between the inside surfaces at the top ends of the upright pillars 111, 111 to some extent, the bundle is not disturbed in its posture by the withdrawal of the claws 124, 124. Further, since the area of the claws 124, 124 to be in contact with the signature is taken fairly broad, there is no possibility at all of their causing abrasion to the printed portions on the lower surface of the lowermost signature in the small bundle. When the claws 124, 124 are retracted, the vertically movable tables 82, 82 with the small bundle being mounted thereon are lowered at one time by a signal from the proximity switch 132. When the uppermost surface of the small bundle comes under the claws 124, 124, the claws 124, 124 are advanced into the frame member 110 and the vertically movable tables 82, 82 are again raised upwardly by a signal from the proximity switch 131, and, at the same time, the direction changing by 180 degrees of the turn table 70 begins. When the vertically movable tables 82, 82 are raised, the small bundle mounted on the top surfaces thereof is held between the lower surfaces of the claws 124, 124 and the top surfaces of the tables 82, 82, whereupon the distal ends of the claws 124, 124 are pushed up and the pivotal pin 122 is lowered with the small roller 114 as the pivot. At this moment, the springs 127, 128 produce reactionary force against the pivot pin 122, and the claws 124, 124 are brought to a substantially horizontal position, whereby the small bundles are subjected to compression. While the claws are assuming this state, the following small bundle is piled up in the space 10, and the lower signature receiving member 12 transfers this subsequent small bundle to the claws 124, 124 which have been brought to a horizontal state. When the second and following small bundles are transferred to and mounted on the claws, the air cylinder 126 takes a timing with the air cylinder 76 shown in FIG. 6. That is to say, the air cylinder 126 is operated in such a manner that the claws 124, 124 may be retracted in a state of the compression force applied to the small bundle held between the claws 124, 124 and the vertically movable tables 82, 82 having been released. As such, there is no possibility at all, during this operation, of causing abrasion to the printed portions on neither the initial nor subsequent small bundles. From that time onward, the vertical movements of the tables 82, 82, the advancing and retracting movements of the claws 124, 124, the direction changing by 180 degrees of the turn table 70, and so on are repeated for an appropriate number of times with adequate timing being taken among them. Since the small bundles to be stacked up during these repeated opeations are subjected to compression at every operation, the uppermost surface of the small bundles maintains its substantial flatness. As soon as the stacking of predetermined number of the small bundles is completed, the vertically movable tables are lowered to their lowest positions, and the small bundles as stacked are pushed out in the direction of an arrow mark Y shown in FIG. 5 by a push-out device 140** shown in FIG. 1 by dot-and-dash lines, and are discharged out of the apparatus. Although any details of the push-out device 140 are dispensed with, a reference numeral 141 designates an air cylinder for the push-out device 140. By the way, when the signatures to be piled up have no bulging-out property owing to the material quality, etc., the vertically movable tables 82, 82 may simply be raised upwardly for receiving the small bundles, without its being used for clamping the small bundle between the claws 124, 124 and the tables 82, 82.

The functions of the small bundle stacking apparatus according to the present invention will now be explained in the following. As has already been described with reference to the foregoing embodiment, the small bundle stacking apparatus of the present invention is constructed with the signature transfer device; the grouping device provided near the exit of the transfer device; the guide members in a bifurcated shape at its main part, which are uprightly provided beneath the exit of the transfer device, at its front position, and at its left and right positions; and the upper and lower signature receiving members which are in fork-shaped so as to be able to move each other in and through the space intervals, and which are movable in both vertical and horizontal directions passing through the space intervals in the upper conveyor and the two guide members at both front and rear positions; and there are given various considerations to and contrivances on even minor portions of the apparatus such that undesirable irregularities, creases, abrasion, and so forth may not occur from spontaneous dropping of the signatures and rubbing of the printed surface thereof. The small bundle stacking device provided beneath the small bundle piling device is so constructed that the center part of the turn table, on which the frame member to receive a small bundle of signatures transferred from the small bundle piling device is fixedly secured and which rotationally changes its direction at every time it receives the small bundle, is made hollow; the vertically movable tables which cause the frame member to move vertically through the hollow center part of the turn table and rotate together with the frame member is provided; further, a plurality of pairs of claws to project into and retract from the frame member from both outer sides of the top opposite surfaces of the frame member are provided; and, by moving these claws and vertically movable tables, the dropping distance of the small bundle handed over from the small bundle piling device is made the shortest. In more detail, when the initial small bundle is received, the vertically movable tables are raised to the highest position into their state of being ready for the subsequent action so as to once receive the small bundle on the top surface of the claws; then the claws are withdrawn out of the frame member to transfer the small bundle onto the top surface of the vertically movable tables; thereafter, the vertically movable tables are moved down until the uppermost surface of the small bundle becomes lower in level than the lower surface of the claws, after which the claws are advanced into the frame member; and subsequently the vertically movable tables are moved upward, while simultanesouly rotating the turn table. In the state of the small bundle being clamped between the vertically movable tables and the claws so as to be subjected to compression, and of the turn table having changed its direction by rotation, when the subsequent small bundle is received on the top surface of the claws, the claws are again retracted from the frame member simultaneously with commencement of moving down of the vertically movable tables, i.e., release of the compression force, and the vertically movable tables are moved down below the level of the claws, after which the claws are again advanced, while raising the tables with simultaneous rotation of the turn table. From that time onward, the advancement-and-withdrawal of the claws, the vertical movements of the vertically movable tables, and the direction changing of the turn table are repeated for a designated number of times, and, at every time the small bundle is piled up, it is subjected to compression, and, after stacking of such small bundles, the vertically movable tables are moved down to its lowest position, followed by horizontal discharging of the stack of the small bundles out of the frame member by a discharging mechanism (when it is necessary from the positional relationship of the discharge port, the turn table is rotated by 90 degrees).

Different from the conventional stacking apparatus, the present invention has made it possible to remarkably reduce the size and weight of the apparatus as a whole by the provision of the direction changing section and the small bundle stacking section beneath the small bundle piling section. In this small bundle stacking section, there is provided the vertically movable table to be moved upward to receive the small bundle into the frame member to thereby minimize the dropping distance of the small bundle, and, at the same time, the frame member and the vertically movable tables are made rotatable by 180 degrees together with the turn table, and, if need be for discharge of the small bundle, by 90 degrees.

Moreover, as mentioned in the foregoing, the uppermost surface of the small bundle of the signatures is not usually even and horizontal on its top surface, but the folded part formed by bunching a number of sheets tends to bulge out much higher, and, moreover, when folded into four, the folded part bulges out even more conspicuously. As the consequence of this, in the case of the signature dropping system as in the present invention, when the initial small bundle is dropped and then the subsequent small bundles are piled up on it one after the other, there take place such situations that shear occurs at the boundary between the mutually adjacent small bundles, or the creases occur as the number of the small bundles stacked increases, even if the direction changing of 180 degrees are effected alternately. With a view to preventing these disadvantages, the apparatus in accordance with the present invention is so designed that the claws are advanced into and withdrawn from the outer sides on the mutually opposite upper surfaces of the frame member, and, at every time the vertically movable tables move upward, the bulged-out folded part of the small bundles of the signatures which have already been stacked is subjected to compression to rectify the uppermost surface of the bundle of signatures to be even and horizontal, after which the small bundle may be stacked sequentially from the top. Therefore, while the apparatus of the present invention is of the dropping system, the apparatus makes it possible to form a large bundle by stacking individual small bundles, each of which assumes accurate rectangular shape in its cross-section and is free from shear and crease at the boundary portion of the adjacent bundles, with much more improvement than the conventional push-up system. Moreover, the present invention has succeeded in reducing the size of the apparatus as a whole to a remarkable degree, which makes it possible to install the apparatus at a smaller space than that required for the conventional apparatus.

While the present invention has been described in the foregoing with reference to specific embodiments thereof, it should be understood that these embodiments are merely illustrative and not so restrictive, and that any changes and modifications may be made by those persons skilled in the art without departing from the spirit and scope of the invention as recited in the appended claims.

I claim:

1. An apparatus for stacking small bundles of signatures, comprising:

means for receiving and stacking signatures;

conveyor means for delivering said signatures to said means for receiving and stacking;

a frame member positioned beneath said means for receiving and stacking;

means for transferring a stack of said signatures to said frame member;

means for rotating said frame member about a vertical axis;

table means;

means for rotating said table means with said frame member and vertically moving said table means;

a plurality of claws including means for positively pivoting said claws about horizontal axes; and means for substantially horizontally moving said horizontal axes such that said claws move into said frame member and retract from said frame member, whereby said claws when moved into said frame member provide compressive forces on the top surface of a stack supported on said table means when said table means is moved upwardly toward said claws.

2. The apparatus for stacking small bundles of signatures according to claim 1, wherein said table means comprises vertically movable tables and a turn table.

3. The apparatus for stacking small bundles of signatures according to claim 1, wherein said means for receiving and stacking said signatures includes a pair of guide members to regulate the front and the rear ends of said signatures to be stacked.

4. The small bundle stacking apparatus according to claim 1, wherein said means for receiving and stacking said signatures comprises an upper signature receiving member; a lower signature receiving member, both said receiving members being of a fork shape so as to be interleaved into a space interval of the other, and a pair of guide members for the front and rear ends of said signatures, wherein said upper signature receiving member includes means for moving said upper signature receiving member downwardly from a level substantially coplanar with the surface of said conveyor means to a level slightly lower than said lower signature receiving member, to a laterally retracted position, thereafter to a vertically raised position forwardly to a position just above said conveyor means, and back to the original position thereof, wherein and said lower signature receiving member includes means for moving said lower signature receiving member, after said upper signature receiving member is laterally retracted, to a lower position, then to a laterally retracted position, thereafter to a vertically raised position and finally, to the original position thereof.

5. The small bundle stacking apparatus according to claim 4, wherein a plurality of air cylinders are provided for moving said upper and lower signature receiving members.

6. The small bundle stacking apparatus according to claim 1, wherein said frame member comprises plural pairs of upright pillars having guide surfaces for signatures, said frame member being connected to a turn table through plural pairs of adjusting blocks which are adjustable for the length of said signatures to be stacked.

* * * * *